US008176885B2

(12) United States Patent
Pierz

(10) Patent No.: US 8,176,885 B2
(45) Date of Patent: May 15, 2012

(54) COOLING SYSTEM WITH FOULING REDUCING ELEMENT

(75) Inventor: Patrick M Pierz, Columbus, IN (US)

(73) Assignee: Cummins Intellectual Properties, Inc., Minneapolis, MN (US)

( * ) Notice: Subject to any disclaimer, the term of this patent is extended or adjusted under 35 U.S.C. 154(b) by 897 days.

(21) Appl. No.: 12/197,917

(22) Filed: Aug. 25, 2008

(65) Prior Publication Data

US 2010/0043732 A1 Feb. 25, 2010

(51) Int. Cl.
*F01P 9/00* (2006.01)

(52) U.S. Cl. ..... 123/41.01; 165/94; 165/95

(58) Field of Classification Search ..... 123/41.01; 165/94, 95
See application file for complete search history.

(56) References Cited

U.S. PATENT DOCUMENTS

| | | | | | |
|---|---|---|---|---|---|
| 1,783,844 | A * | 12/1930 | Jacobsen | ..... | 165/85 |
| 4,174,750 | A * | 11/1979 | Nichols | ..... | 165/94 |
| 4,583,585 | A * | 4/1986 | Estienne et al. | ..... | 165/94 |
| 4,641,705 | A * | 2/1987 | Gorman | ..... | 165/85 |
| 4,993,485 | A * | 2/1991 | Gorman | ..... | 165/85 |
| 6,360,532 | B2 * | 3/2002 | Strahle et al. | ..... | 60/321 |
| 7,836,941 | B2 * | 11/2010 | Song et al. | ..... | 165/95 |
| 2008/0202728 | A1 * | 8/2008 | Cottard et al. | ..... | 165/94 |

* cited by examiner

*Primary Examiner* — Marguerite McMahon
*Assistant Examiner* — James Kim
(74) *Attorney, Agent, or Firm* — Studebaker & Brackett PC; Tim L. Brackett, Jr.

(57) ABSTRACT

A system and method for reducing fouling. In one embodiment, the system includes a housing and a plurality of channels contained within the housing. The system also includes a fouling reduction element that passes through at least one channel of the plurality of channels, wherein the fouling reduction element is movable such that it reduces fouling inside of the at least one channel. According to the system and method disclosed herein, the fouling reduction element efficiently cleans the inside of the channels of the cooling system.

15 Claims, 4 Drawing Sheets

COOLING SYSTEM WITH FOULING REDUCING ELEMENT

FIELD OF THE INVENTION

The present invention relates to engine systems, and more particularly to a cooling system.

BACKGROUND OF THE INVENTION

Cooling systems for engines are well known. Exhaust gas recirculation (EGR) coolers are cooling systems that are typically mounted on an engine intake manifold to cool exhaust gas that passes through the engine intake manifold. Coolant fluid passes around tubes within the EGR cooler to cool the exhaust gas that passes through the tubes. One problem with conventional EGR coolers is that the inside of the tubes get covered with soot and ash. Such fouling from the soot and ash adversely affects the efficiency of the EGR cooler over time by reducing the efficiency of the tubes. Build up of fouling inside the tubes may lead to increased intake manifold temperatures and nitrogen oxide (NOx) emissions. To compensate, EGR coolers are typically designed significantly larger to account for performance loss over time.

Accordingly, what is needed is an improved cooling system that addressing the soot and ash problem. The present invention addresses such a need.

SUMMARY OF THE INVENTION

A system and method for reducing fouling is disclosed. In one embodiment, the system includes a housing and a plurality of channels contained within the housing. The system also includes a fouling reduction element that passes through at least one channel of the plurality of channels, wherein the fouling reduction element is movable such that it reduces fouling inside of the at least one channel.

According to the system and method disclosed herein, the fouling reduction element efficiently cleans the inside of the channels of the cooling system.

DETAILED DESCRIPTION OF THE INVENTION

The present invention relates to engine systems, and more particularly to fouling reduction. The following description is presented to enable one of ordinary skill in the art to make and use the invention, and is provided in the context of a patent application and its requirements. Various modifications to the preferred embodiment and the generic principles and features described herein will be readily apparent to those skilled in the art. Thus, the present invention is not intended to be limited to the embodiments shown, but is to be accorded the widest scope consistent with the principles and features described herein.

A system and method in accordance with the present invention for reducing fouling is disclosed. In one embodiment, the fouling reduction system includes a housing and a plurality of channels contained within the housing. The fouling reduction system also includes a fouling reduction element that passes through at least one channel of the plurality of channels, wherein the fouling reduction element is movable such that it reduces fouling inside of the at least one channel. As a result, the fouling reduction element efficiently cleans the inside of the channels of the cooling system. To more particularly describe the features of the present invention, refer now to the following description in conjunction with the accompanying figures.

Although the present invention disclosed herein is described in the context of tubes for exhaust gas in an EGR cooler, the present invention may apply to other portions of a vehicle such as vehicle frame drain holes, and still remain within the spirit and scope of the present invention.

Figure 1:
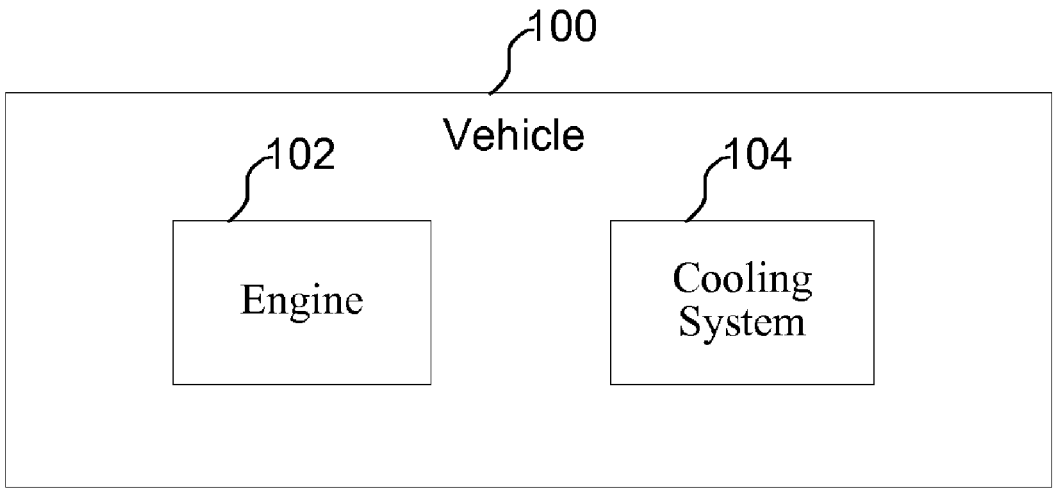
FIG. 1 is a block diagram of a vehicle in accordance with one embodiment.

FIG. 1 is a block diagram of a vehicle in accordance with one embodiment. As FIG. 1 shows, the vehicle 100 includes an engine 102 and a cooling system 104. In particular embodiments, the cooling system 104 may be an exhaust gas recirculation (EGR) cooler. In one embodiment, the cooling system 104 may be mounted on the engine intake manifold to cool exhaust gas that passes through the engine intake manifold. Embodiments of the present invention may apply to other portions of a vehicle, and still remain within the spirit and scope of the present invention. For example, in one embodiment, the cooling system 104 may be mounted on or integrated with the radiator of the engine.

Figure 2:
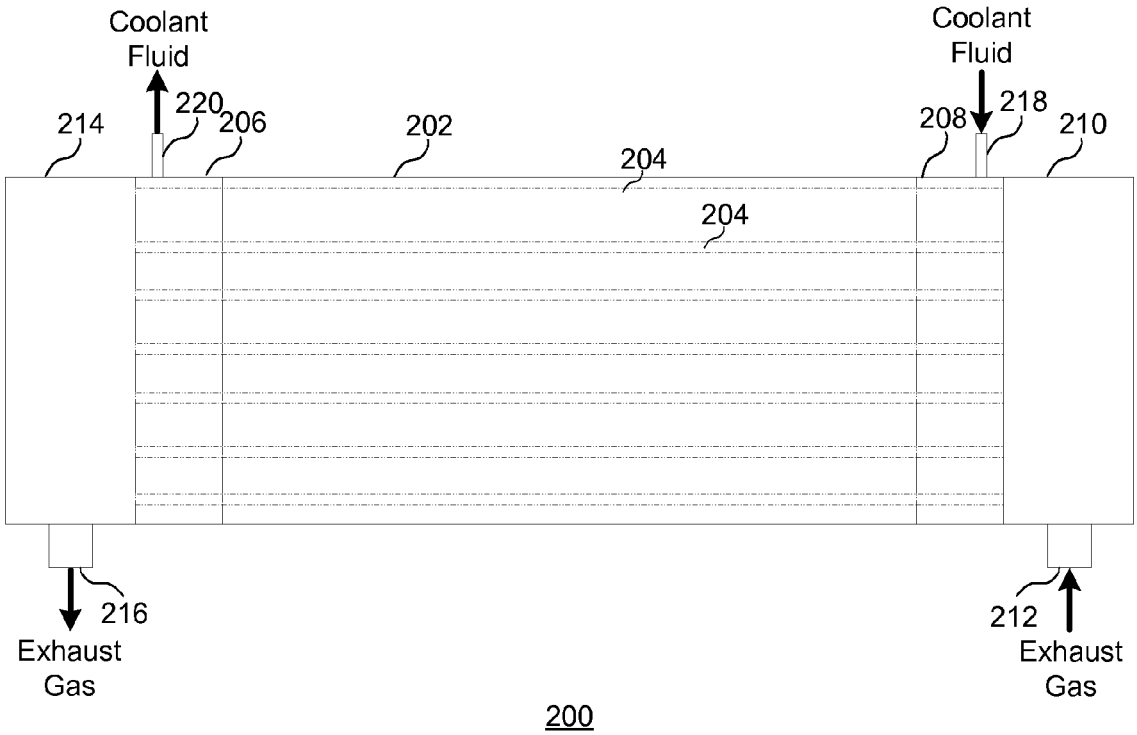
FIG. 2 is a block diagram of an EGR cooler in accordance with one embodiment.

FIG. 2 is a block diagram of an EGR cooler 200 in accordance with one embodiment. As FIG. 2 shows, the EGR cooler 200 includes an EGR cooler includes a housing 202 and channels or tubes 204 located within the housing 202. In one embodiment, the tubes 204 may be 5-6 millimeters in diameter, or other suitable sizes. The EGR cooler 200 also includes a header plate 206 and an end plate 208, each of which has holes through which the tubes 204 are inserted and soldered. The EGR cooler 200 also includes an exhaust gas inlet housing 210 that collects exhaust gas via an exhaust gas inlet 212 and distributes the exhaust gas evenly among the tubes 204. The EGR cooler 200 also includes an exhaust gas outlet housing 214 that collects the exhaust gas from the tubes 204 and discharges the exhaust gas via an exhaust gas outlet 216 for recirculation. The EGR cooler 200 also includes a coolant inlet 218 for receiving coolant fluid and a coolant outlet 220 for ejecting the coolant fluid.

In operation, the exhaust gas passes through the center of the tubes 204, and the coolant fluid flows over the tubes to lower the temperature of the exhaust gas, where heat is transferred from the exhaust gas to the coolant fluid.

Figure 3:
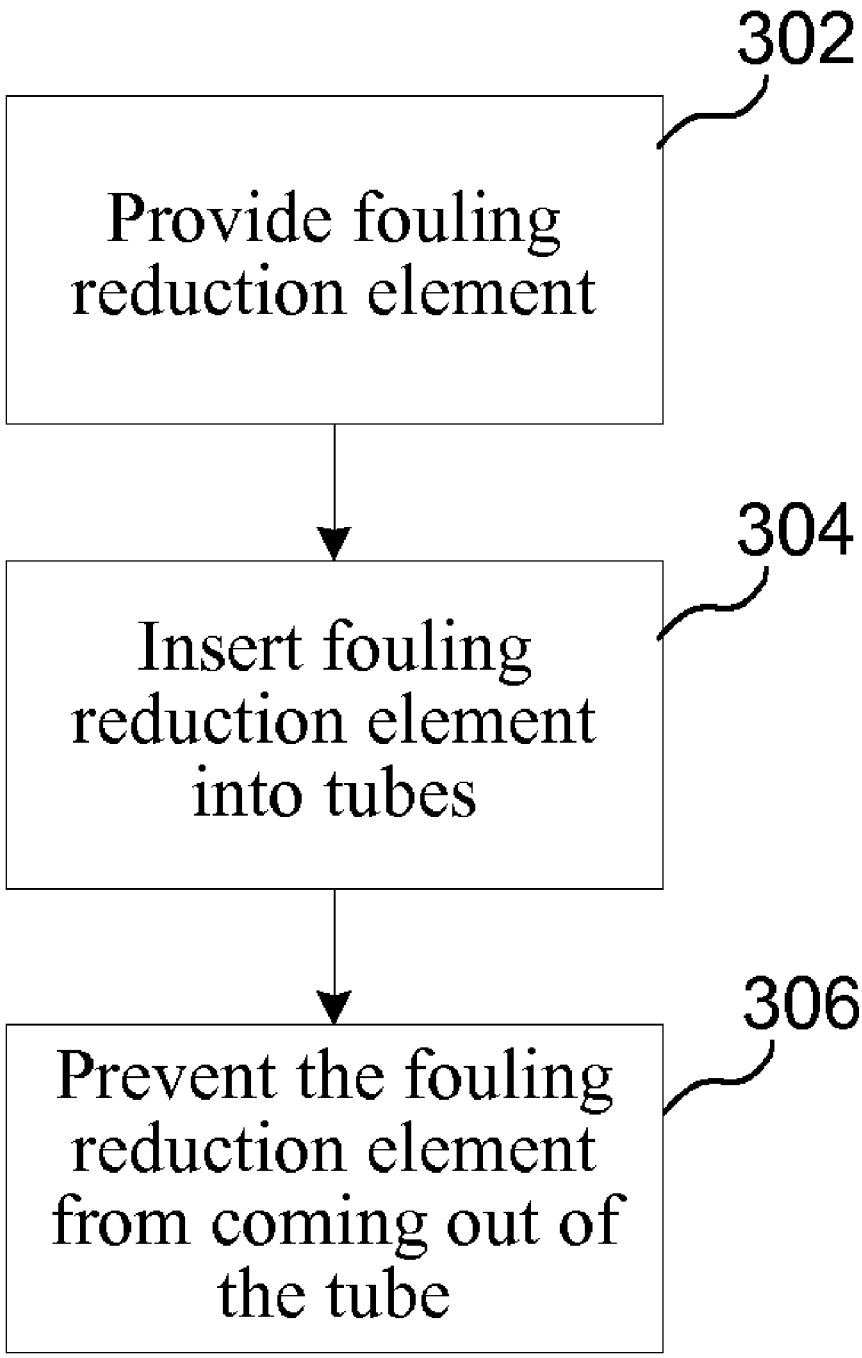
FIG. 3 is a flow chart showing a method for reducing fouling inside the tubes of a cooling system in accordance with one embodiment of the present invention.
Figure 4:
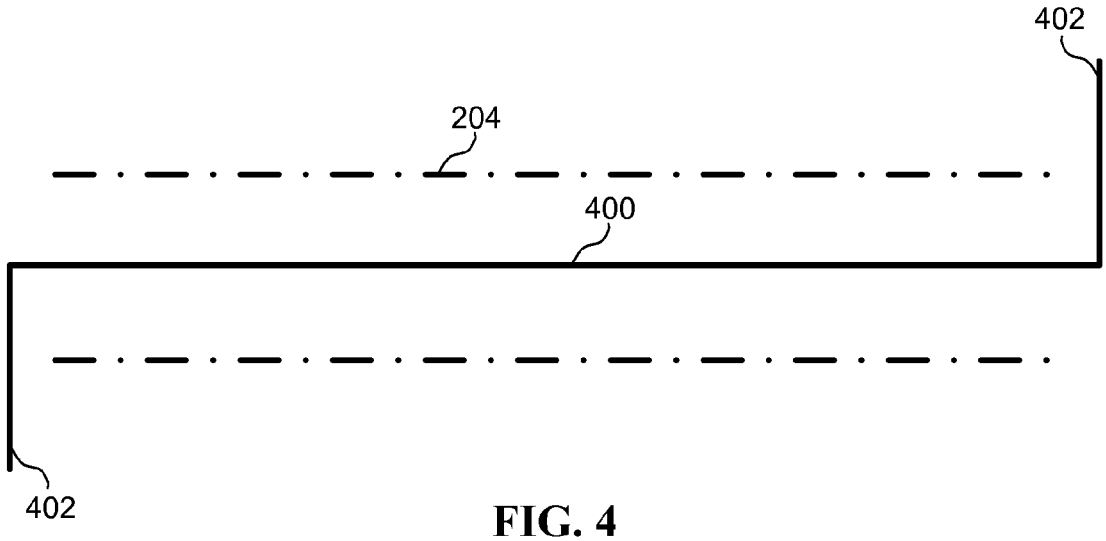
FIG. 4 is a cross-section diagram of a fouling reduction element inserted in a tube in accordance with one embodiment.

FIG. 3 is a flow chart showing a method for reducing fouling inside the tubes of a cooling system in accordance with one embodiment of the present invention. FIG. 4 is a cross-section diagram of a fouling reduction element inserted in a tube in accordance with one embodiment. The process begins in step 302 where the fouling reduction 400 element is provided. In one embodiment, the fouling reduction element 400 may be a thin wire made of stainless steel. In particular embodiments, the wire may be one half to one millimeter in diameter. As noted above, the tubes 204 may be 5-6 millimeters in diameter. As such, the fouling reduction element 400 takes up only a small portion of the inside of a given tube 204. Hence, the fouling reduction element 400 does not impede flow but rather maximizes the flow of the exhaust gas, as described in more detail below. Although the present invention disclosed herein is described in terms of a stainless steel, wire fouling reduction element, the present invention may apply to other shapes, sizes, and materials, and still remain within the spirit and scope of the present invention. For example, instead of a wire, a ball shaped element may be inserted in the tubes to vibrate and clean the inside of the walls. Also, although the fouling reduction element 400 is described to function within a tube, embodiments of the fouling reduction 400 element may apply to other types of closed channels, regardless of the shape of the channels, and still remain within the spirit and scope of the present invention.

Next, in step 304, the fouling reduction element 400 is inserted into each of the tubes 204 as shown in FIG. 4. In one embodiment, some or all of the tubes contain a fouling reduction element 400. Next, in step 306, a means is provided for preventing the fouling reduction element 400 from coming out of the tube. For example, in one embodiment, as FIG. 4 shows, the fouling reduction element 400 is longer than the tube 204 and thus extends out of the tube 204 at both ends. The fouling reduction element 400 is bent at each end such that each bent end 402 of the fouling reduction element is outside the tube 204. The bent ends 402 provide stops at each end of the tube 204 in order to prevent the fouling reduction element 400 from coming out of the tube 204, yet still be free to move and vibrate as described below.

In operation, the fouling reduction 400 element is free to move within a given tube 204 in response to engine vibration. For example, as the engine vibrates, the vibrations will pass from the engine to the fouling reduction element 400 via other engine parts such as the walls of the tubes 204. As the fouling reduction element 400 moves or vibrates, the fouling reduction element 400 impacts or rubs against the inside wall of the tube 204. Such action (impact, rubbing, etc.) against the inside walls of the tube 204 removes deposits from the walls. In one embodiment, the fouling reduction element 400 may be forced to move by other means such as an actuator or exhaust gas flow.

In effect, the fouling reduction element 400 maximizes flow of the exhaust gas within the tube 204 as it cleans the inside of the tube 204. Also, without the fouling reduction element 400, built-up fouling creates an insulating layer within the walls of the tubes 204, which prevents heat exchange between the exhaust gas inside the tubes 204 and the coolant fluid outside the tubes 204. As such, the temperature of the exhaust gas goes up. The fouling reduction element 400, by continually cleaning the inside of the walls, facilitates in maximizing the heat exchange between the exhaust gas and the coolant fluid. As such, the temperature of the exhaust gas goes down.

According to the system and method disclosed herein, the present invention provides numerous benefits. For example, embodiments of the present invention are simple and require no active logic.

A system and method in accordance with the present invention for reducing fouling has been disclosed. In one embodiment, the fouling reduction system includes a housing and a plurality of channels contained within the housing. The fouling reduction system also includes a fouling reduction element that passes through at least one channel of the plurality of channels, wherein the fouling reduction element is movable such that it reduces fouling inside of the at least one channel. As a result, the fouling reduction element efficiently cleans the inside of the channels of the cooling system.

The present invention has been described in accordance with the embodiments shown. One of ordinary skill in the art will readily recognize that there could be variations to the embodiments, and that any variations would be within the spirit and scope of the present invention. Accordingly, many modifications may be made by one of ordinary skill in the art without departing from the spirit and scope of the appended claims.

What is claimed is:

1. An engine cooling system comprising:

a housing;

a plurality of channels contained within the housing; and a fouling reduction element that passes through at least one channel of the plurality of channels, wherein the fouling reduction element is movable such that it reduces fouling inside of the at least one channel, wherein the fouling reduction element is a wire that is longer than the at least one channel and extends out of the at least one channel at both ends of the at least one channel to form extended portions, at least one of the extended portions of the wire being bent to form a bent end extending transverse to a longitudinal axis of the at least one channel, said bent end having a length greater than a diameter of said at least one channel to provide a stop to prevent the fouling reduction element from coming out of the at least one channel.

2. The system of claim 1 wherein the fouling reduction element moves within the at least one channel and against inside of walls of the at least one channel to remove deposits from the walls.

3. The system of claim 1 wherein the fouling reduction element moves within the at least one channel in response to engine vibration.

4. The system of claim 1 wherein the fouling reduction element moves within the at least one channel in response to exhaust gas.

5. The system of claim 1 wherein the fouling reduction element is a wire.

6. The system of claim 1 wherein the fouling reduction element is a wire that is longer than the at least one channel and that extends out of the at least one channel at both ends of the at least one channel.

7. A vehicle comprising:

an engine; and an engine cooling system coupled to the engine, the engine cooling system comprising:

a housing;

a plurality of channels contained within the housing; and a fouling reduction element that passes through at least one channel of the plurality of channels, wherein the fouling reduction element is movable such that it reduces fouling inside of the at least one channel, wherein the fouling reduction element is a wire that is longer than the at least one channel and extends out of the at least one channel at both ends of the at least one channel to form extended portions, at least one of the extended portions of the wire being bent to form a bent end extending transverse to a longitudinal axis of the at least one channel, said bent end having a length greater than a diameter of said at least one channel to provide a stop to prevent the fouling reduction element from coming out of the at least one channel.

8. The vehicle of claim 7 wherein the fouling reduction element moves within the at least one channel and against inside of walls of the at least one channel to remove deposits from the walls.

9. The vehicle of claim 7 wherein the fouling reduction element moves within the at least one channel in response to engine vibration.

10. The vehicle of claim 7 wherein the fouling reduction element moves within the at least one channel in response to exhaust gas.

11. The vehicle of claim 7 wherein the fouling reduction element is a wire.

12. The vehicle of claim 7 wherein the fouling reduction element is a wire that is longer than the at least one channel and that extends out of the at least one channel at both ends of the at least one channel.

13. A method comprising:

providing a fouling reduction element; and inserting the fouling reduction element into at least one channel of a plurality of channels, wherein the fouling reduction element is movable such that it reduces fouling inside of the at least one channel, wherein the fouling reduction element is a wire that is longer than the at least one channel and extends out of the at least one channel at both ends of the at least one channel to form extended portions, at least one of the extended portions of the wire being bent to form a bent end extending transverse to a longitudinal axis of the at least one channel, said bent end having a length greater than a diameter of said at least one channel to provide a stop to prevent the fouling reduction element from coming out of the at least one channel.

14. The method of claim 13 wherein the fouling reduction element moves within the at least one channel and against inside of walls of the at least one channel to remove deposits from the walls.

15. The method of claim 13 wherein the fouling reduction element is a wire.

* * * * *